US010595142B2

(12) United States Patent
Avanasi

(10) Patent No.: US 10,595,142 B2
(45) **Date of Patent: *Mar. 17, 2020**

(54) HEARING INSTRUMENT AND METHOD OF PROVIDING SUCH HEARING INSTRUMENT

(71) Applicant: GN Hearing A/S, Ballerup (DK)

(72) Inventor: Senthil Avanasi, Hoffman Estates, IL (US)

(73) Assignee: GN Hearing A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/163,511

(22) Filed: Oct. 17, 2018

(65) Prior Publication Data

US 2019/0052983 A1 Feb. 14, 2019

Related U.S. Application Data

(63) Continuation of application No. 14/668,873, filed on Mar. 25, 2015, now Pat. No. 10,244,337.

(51) Int. Cl.

| | |
|---|---|
| ***H04R 25/00*** | (2006.01) |
| ***G06Q 30/04*** | (2012.01) |
| ***H04S 7/00*** | (2006.01) |

(52) U.S. Cl.

CPC ..... *H04R 25/70* (2013.01); *G06Q 30/04* (2013.01); *H04S 7/00* (2013.01); *H04R 2225/00* (2013.01); *H04R 2225/021* (2013.01); *H04R 2225/025* (2013.01); *H04S 2420/01* (2013.01)

(58) Field of Classification Search

CPC combination set(s) only.

See application file for complete search history.

(56) References Cited

U.S. PATENT DOCUMENTS

| | | | | |
|---|---|---|---|---|
| 6,556,686 | B1 | 4/2003 | Weidner | |
| 6,658,307 | B1 * | 12/2003 | Mueller | H04R 25/70 381/23.1 |
| 8,767,986 | B1 * | 7/2014 | Fabry | H04R 25/70 381/314 |

(Continued)

OTHER PUBLICATIONS

Final Office Action dated Jul. 13, 2018 for related U.S. Appl. No. 14/668,873.

(Continued)

*Primary Examiner* — Duc Nguyen
*Assistant Examiner* — Assad Mohammed
(74) *Attorney, Agent, or Firm* — Vista IP Law Group, LLP

(57) ABSTRACT

A method of providing a hearing instrument includes: providing at a manufacturer the hearing instrument with a firmware which comprises a plurality of selectable functional properties; distributing the hearing instrument from the manufacturer to a middleman, wherein the hearing instrument is configured to be programmed by a programming station at the middleman, wherein the programming station is configured for selecting at least one of the plurality of selectable functional properties according to an input from the middleman, wherein the programming station is also configured to program the firmware of the hearing instrument according to the selecting to provide a programmed hearing instrument; billing an end user for the programmed hearing instrument, wherein the billing reflects the selecting; and receiving, at the manufacturer, data regarding the selecting from the middleman.

31 Claims, 1 Drawing Sheet

(56) References Cited

U.S. PATENT DOCUMENTS

| | | | | |
|---|---|---|---|---|
| 2002/0054689 | A1* | 5/2002 | Zhang | H04R 25/70 381/312 |
| 2009/0159673 | A1 | 6/2009 | Mullen | |
| 2010/0131078 | A1 | 5/2010 | Brown | |
| 2014/0010393 | A1* | 1/2014 | Kvist | H04R 25/554 381/315 |

OTHER PUBLICATIONS

Notice of Allowance and Fee(s) dated Nov. 5, 2018 for related U.S. Appl. No. 14/668,873.
Non-final Office action dated Nov. 8, 2017 for related U.S. Appl. No. 14/668,873.
Advisory Action dated Jul. 28, 2017 for related U.S. Appl. No. 14/668,873.
Final Office Action dated Apr. 12, 2017 for related U.S. Appl. No. 14/668,873.
Non-Final Office Action dated May 26, 2016 for related U.S. Appl. No. 14/668,873.

* cited by examiner

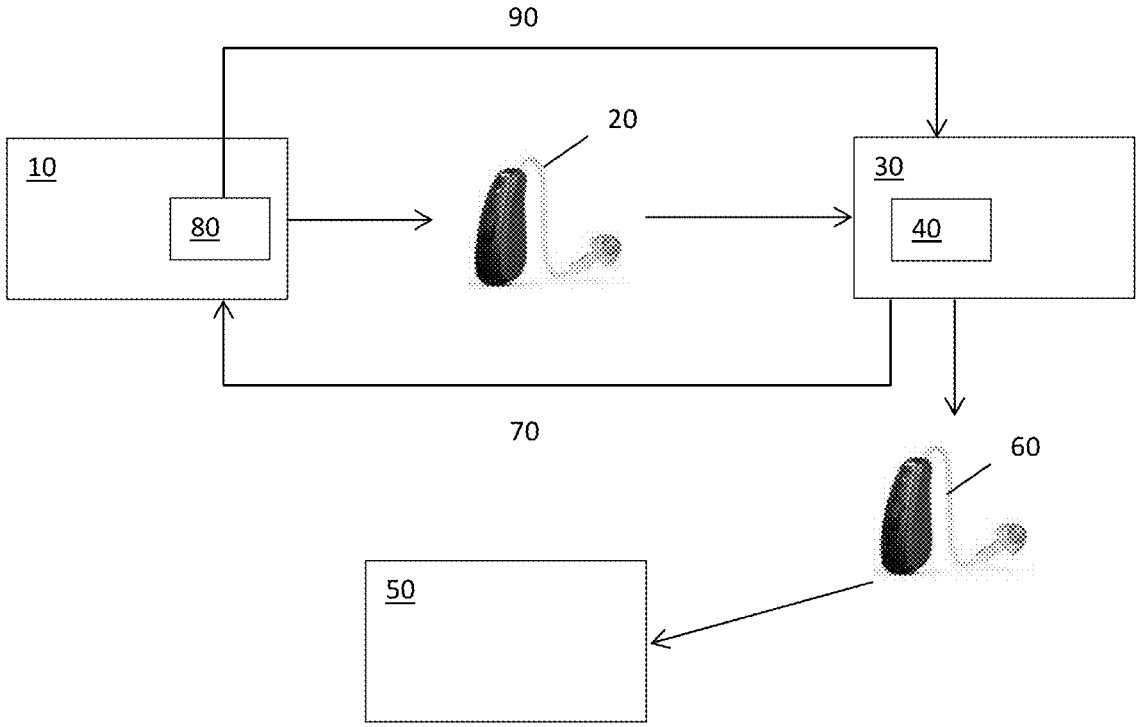
90
20
10
80
30
40
70
60
50

HEARING INSTRUMENT AND METHOD OF PROVIDING SUCH HEARING INSTRUMENT

RELATED APPLICATION DATA

This application is a continuation of U.S. patent application Ser. No. 14/668,873 filed on Mar. 25, 2015, issued as U.S. Pat. No. 10,244,337. The entire disclosure of the above application is expressly incorporated by reference herein.

FIELD

The subject disclosure relates to a method of programming functional properties of a hearing instrument and to a hearing instrument comprising programmable selectable functional properties.

BACKGROUND

Certain types of hearing instruments have functional properties that are influenced by a firmware. Different firmwares permit varying functions to be implemented, including implementing various function programs and selecting the type of noise suppression or similar functions.

The hearing instrument type, which is sold as a final product to the end user, i.e., the hearing instrument user, ultimately depends on the programming, i.e., on the configuration of the firmware employed.

U.S. Pat. No. 6,658,307 discloses a method with which audiological devices, particularly hearing instruments, can be adapted in a simple way to the requirements of the user and with which organizational distribution outlay can be reduced by a method for configuring the functional properties of an audiological device, comprising the steps of: a) providing the audiological device with an IC that can be differently configured in view of functional properties of the IC; b) providing a configuration upgrading information in a suitable data store; c) initially configuring the IC at a manufacturing facility such that the audiological device comprises minimal possible properties in a basic version, and distributing the basic version of the device at a basic price to a middleman or dealer; d) obtaining upgrade information by either: 1) loading configuration upgrading information onto a separate data carrier at the manufacturing facility and distributing the loaded data carrier, to a middleman or dealer, at a price that is dependent on a type and number of configuration upgrading information packages contained on the data carrier for use on a programming station located at the middleman or dealer, or 2) transmitting configuration upgrading information in an online operation from a software memory of a manufacturer at the manufacturing facility, to a buffer memory of a programming station located at the middleman or dealer; e) introducing the IC into the programming station and at least partially reading-in the configuration upgrading information from the separate data carrier or the online operation, into the programming station for programming and upgrading the IC to a customized, higher function level; and f) distributing and billing customers for an audiological device upgraded in this manner such that the billing reflects additional functional properties over the basic version.

SUMMARY

An object of the present disclosure is to simplify configuration of hearing instruments at a middleman such as a hearing instrument dealer and/or to reduce the required inventory of said middleman and/or a manufacturer of said hearing instruments.

A first aspect for solving the above object is a method of programming functional properties of a hearing instrument, comprising providing at a manufacturer said hearing instrument with a firmware which comprises a plurality of selectable functional properties; distributing said hearing instrument from said manufacturer to a middleman; introducing said hearing instrument into a programming station at said middleman, wherein said programming station is configured for selecting at least one of said plurality of selectable functional properties according to an input from said middleman; and to program the firmware of said hearing instrument according to said selecting to provide a programmed hearing instrument; distributing and billing an end user for the programmed hearing instrument resulting in said billing reflecting the selecting; and transmitting from the middleman to the manufacturer data regarding said selecting.

The solution enables the manufacturer to distribute e.g. a single type of hearing instrument model to the middleman/dealer of hearing instruments. Thereby, the inventory of both the manufacturer and the middleman may be reduced.

The distributed hearing instrument comprises firmware in which a plurality of selectable functional properties such as for example tinnitus signal generation, binaural directionality, surround sound processor, wind-noise guard are contained.

In an embodiment, the plurality of selectable functional properties may be enabled or disabled or some of the plurality of selectable functional properties may be enabled and some may be disabled.

The selectable functional properties may in an embodiment be enabled and/or disabled by the manufacturer.

The hearing instrument is distributed to a middleman. The middleman may be a hearing instrument dealer.

Further, because the distributed hearing instrument already comprises the plurality of selectable functional properties, the manufacturer does not need to transmit upgrade information to the middleman either online or via a data-carrier. Thereby, the manufacturer reduces the amount of resources used in connection with distributing and programming the hearing instrument.

The middleman introduces the hearing instrument into a programming station in order to program the hearing instrument by selecting a number of the plurality of selectable functional properties. The selection of functional properties may reflect a desire from and/or request from and/or a need of an end user. When the selection has been made, the programming station programs the firmware of the hearing instrument according to the selection.

In an embodiment, the programming of the firmware comprises enabling the selected functional properties in the hearing instrument and disabling non-selected functional properties in the firmware of the hearing instrument. The enabling and/or disabling may be performed by programming the firmware of the hearing instrument e.g. by writing a code into a memory of the hearing instrument reflecting the selection by the programming station.

The middleman distributes the hearing instrument to an end user and bills the end user according to the number of enabled functional properties programmed to the hearing instrument.

The middleman transmits data to the manufacturer, the data reflecting the functional properties selected as enabled and disabled in the programming of the hearing instrument.

In an embodiment, the plurality of selectable functional properties of the firmware of the hearing aid distributed by the manufacturer may be in a state where they are enabled (unlocked). In an embodiment, the plurality of functional properties of the firmware of the hearing aid distributed by the manufacturer may be in a state where they are disabled (locked).

An embodiment according to the method, wherein the firmware of said hearing instrument comprises all functional properties available in said hearing instrument. In this embodiment, the hearing instrument distributed from the manufacturer to the middleman contains all functional properties available to the manufacturer i.e. the hearing instrument is fully-featured.

An embodiment according to the method, wherein each of said selectable functional properties may be locked or unlocked by said selecting at said middleman. Thereby, the middleman is provided with the possibility of fully individualizing the hearing instrument to the end user.

An embodiment according to the method, wherein each of said selectable functional properties may be locked or unlocked by a selection at said manufacturer. Thereby, the manufacturer may distribute e.g. non-working hearing instruments (all functional properties being locked) to the middleman thereby making theft of the hearing instruments by a third party less interesting. Alternatively, the manufacturer may distribute top of the line hearing instruments to the middleman.

An embodiment according to the method, wherein a locked selectable functional property is unavailable in said programmed hearing instrument to said end user and an unlocked selectable functional property is available in said programmed hearing instrument to said end user.

An embodiment according to the method, wherein at least one of said plurality of selectable functional properties is unlocked by said manufacturer. Thereby, the manufacturer may enable one or some of the selectable functional properties before distributing the hearing instrument to the middleman.

An embodiment according to the method, wherein said distributed hearing instrument is distributed to said middleman at a first price.

An embodiment according to the method, wherein said billing of said end user is performed at a second price, wherein said second price is larger than said first price. The middleman may charge a higher price for the hearing instrument distributed to the end user than the middleman has paid the manufacturer.

An embodiment according to the method, wherein said billing of said end user is performed at a second price, wherein said second price reflects said selecting. Thereby, the billing of the end user depends on the functional properties selected/locked/unlocked.

An embodiment according to the method, wherein each of said selectable functional properties are locked by said manufacturer prior to distributing to said middleman. Thereby, the manufacturer may distribute e.g. non-working hearing instruments (all functional properties being locked) to the middleman thereby making theft of the hearing instruments by a third party less interesting.

An embodiment according to the method, wherein each of said selectable functional properties are unlocked by said manufacturer prior to distributing to said middleman. The manufacturer may distribute top of the line hearing instruments to the middleman.

An embodiment according to the method, wherein introducing said hearing instrument into said programming station at said middleman comprises establishing a wired or a wireless communication link between said programming station and said hearing instrument. Thereby, the hearing instrument may be connected to the programming station either wirelessly or via a cable.

An embodiment according to the method, wherein the wireless communication link is a short-range wireless communication link.

An embodiment according to the method, wherein the short-range wireless communication link is a Bluetooth Low Energy communication link.

An embodiment according to the method, wherein transmitting from the middleman to the manufacturer data regarding said selecting comprises establishing a communication link between said programming station and a server located at said manufacturer. Thereby, the middleman may transmit the data via the communication link.

An embodiment according to the method, wherein said communication link comprises a public network.

An embodiment according to the method, wherein said public network comprises the Internet.

An embodiment according to the method, wherein to program the firmware of said hearing instrument according to said selecting in said programming station comprises generating a security ID at said programming station and to store said security ID on a memory device contained in said hearing instrument. Thereby, locking and/or unlocking of features on the hearing instrument is tamper-proof.

An embodiment according to the method, wherein said security key comprises information about said selecting.

An embodiment according to the method, wherein said security ID is generated at said programming station utilizing a security key, which security key has been obtained by said middleman in a registration process at a server located at said manufacturer. Thereby, the manufacturer controls what persons/middlemen may program said firmware.

An embodiment according to the method, wherein the method further comprises billing said middleman by said manufacturer based on said data regarding said selecting.

A second aspect for solving the above object is a hearing instrument comprising programmable selectable functional properties, wherein the hearing instrument is programmed and distributed according to the method of the first aspect.

A method of providing a hearing instrument includes: providing at a manufacturer the hearing instrument with a firmware which comprises a plurality of selectable functional properties; distributing the hearing instrument from the manufacturer to a middleman, wherein the hearing instrument is configured to be programmed by a programming station at the middleman, wherein the programming station is configured for selecting at least one of the plurality of selectable functional properties according to an input from the middleman, wherein the programming station is also configured to program the firmware of the hearing instrument according to the selecting to provide a programmed hearing instrument; billing an end user for the programmed hearing instrument, wherein the billing reflects the selecting; and receiving, at the manufacturer, data regarding the selecting from the middleman.

Optionally, the firmware of the hearing instrument comprises substantially all functional properties available to the manufacturer.

Optionally, at least one or all of the selectable functional properties can be locked or unlocked.

Optionally, when one of the selectable functional properties is locked, it is unavailable to the end user in the programmed hearing instrument, and when the one of the selectable functional properties is unlocked, it is available to the end user in the programmed hearing instrument.

Optionally, at least one or all of the selectable functional properties can be locked or unlocked by the selecting at the middleman.

Optionally, at least one or all of the selectable functional properties can be locked or unlocked by a process at the manufacturer.

Optionally, at least one of the plurality of selectable functional properties is unlocked by the manufacturer.

Optionally, the distributed hearing instrument is distributed to the middleman at a first price.

Optionally, the billing the end user is performed at a second price, wherein the second price is larger than the first price.

Optionally, the billing the end user is performed at a second price, wherein the second price reflects the selecting.

Optionally, at least one or all of the selectable functional properties are locked by the manufacturer before the act of distributing.

Optionally, at least one or all of the selectable functional properties are unlocked by the manufacturer before the act of distributing.

Optionally, the method further includes communicatively coupling the hearing instrument with the programming station at the middleman by establishing a wired or a wireless communication link between the programming station and the hearing instrument.

Optionally, the wireless communication link is a short-range wireless communication link.

Optionally, the short-range wireless communication link is a Bluetooth Low Energy communication link.

Optionally, the act of receiving the data regarding the selecting comprises establishing a communication link between the programming station and a server located at the manufacturer.

Optionally, the communication link comprises a public network.

Optionally, the public network comprises the Internet.

Optionally, the method further includes program the firmware of the hearing instrument according to the selecting; wherein the act of programming comprises: generating a security ID at the programming station; and storing the security ID on a memory device contained in the hearing instrument.

Optionally, the security ID comprises information about the selecting.

Optionally, the security ID is generated at the programming station utilizing a security key, and wherein the security key is provided to the middleman in a registration process using a server located at the manufacturer.

Optionally, the method further includes billing the middleman based on the data regarding the selecting.

A hearing instrument comprising programmable selectable functional properties, wherein the hearing instrument is programmed and distributed according to any of the techniques described herein.

A hearing instrument includes: a microphone configured for conversion of sound into an audio signal; a processing unit coupled to the microphone, wherein the processing unit is programmable to provide a hearing loss compensated output signal that compensates for a hearing loss of a user based at least in part on the audio signal; and a speaker coupled to the processing unit; wherein the processing unit includes a first functional property, the first functional property having a first locked state and a first unlocked state; wherein when the first functional property is in the first locked state, it is unavailable to the user, and when the first functional property is in the first unlocked state, it is available to the user.

Optionally, the processing unit is configured to be programmed by a programming station to place the first functional property at the first locked state or the first unlocked state.

Optionally, the first functional property is resided in the processing unit even when the first functional property is in the first unlocked state.

Optionally, the processing unit comprises a firmware that includes the first functional property.

Optionally, the processing unit includes a non-transitory medium for storing information indicating whether the first functional property is at the first locked state or the first unlocked state.

Optionally, the processing unit is configured to receive a security ID from a programming station.

Optionally, the processing unit includes a non-transitory medium storing information regarding the first functional property.

Optionally, the hearing instrument comprises a behind-the-ear (BTE) device, an in-the-ear (ITE) device, an in-the-canal (ITC) device, or a binaural hearing system.

Other and further aspects and features will be evident from reading the following detailed description.

DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting in the scope of the claims.

FIG. 1 shows distribution of a hearing instrument from a manufacturer to a middleman to an end user.

DETAILED DESCRIPTION

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

FIG. 1 shows a hearing instrument manufacturer 10. The manufacturer distributes at least one hearing instrument 20 to a middleman 30 such as a hearing instrument dealer or dispenser.

The hearing instrument 20 comprises a firmware which comprises a plurality of selectable functional properties when being distributed from the manufacturer 10. Examples of selectable functional properties may be tinnitus signal generation, binaural directionality, surround sound processor, wind-noise guard.

In an embodiment, the hearing instrument distributed from the manufacturer comprises a maximal number of selectable functional properties such as all possible features available from the manufacturer.

In an embodiment, all the selectable functional properties of the hearing instrument are disabled when the hearing instrument is distributed from the manufacturer thereby making the hearing instrument uninteresting for a thief.

In an embodiment, all the selectable functional properties of the hearing instrument are enabled when the hearing instrument is distributed from the manufacturer thereby making the hearing instrument fully-featured when distributed to the middleman.

The middleman 30 receives the hearing instrument 20 from the manufacturer 10. The middleman 30 may introduce the hearing instrument 20 into a programming station 40. The hearing instrument 20 may e.g. be connected to the programming station 40 via a cable or wirelessly via a short-range communication link such as Bluetooth Low Energy.

The middleman may, possibly in cooperation with an end user 50, select a number of selectable functional properties to be enabled and a number of selectable functional properties to be disabled. In an embodiment, all selectable functional properties are selected to be enabled. In another embodiment, only a single selectable functional property is selected to be enabled. In a third embodiment, a plurality of selectable functional properties are selected to be enabled and at least one selectable functional property is selected to be disabled.

The programming station generates a security ID based on the enabled and disabled selection of selectable functional properties. The security ID is programmed into the firmware of the hearing instrument by the programming station by storing the security ID in a memory of the hearing instrument. The programming of the hearing instrument 20 results in a programmed hearing instrument 60.

In an embodiment, the security ID is calculated by the programming station 40 using a security key. The security key may be received by the middleman 30 from the manufacturer after a registration of the middleman 30 on a server 80 located at the manufacturer 30. The registration may comprise name, email, phone-number, etc. of the middleman. Based on the registration, the manufacturer may transmit the security key to the middleman 30.

The middleman 30 may sell the programmed hearing instrument 60 to the end user 50. In an embodiment, the middleman 30 distributes the programmed hearing instrument 60 to the end user 50. The middleman 30 may also bill the end user 60 for the programmed hearing instrument 60.

The middleman 30 transmits data 70 to the server 80 located at the manufacturer 10. The data 70 may comprise information regarding which of the selectable functional properties were enabled and which of the functional properties were disabled.

Based on the data 70, the server 80 may calculate, prepare and transmit an invoice 90 to the middleman 30. The calculation may comprise a valuation of the enabled and/or disabled selectable functional properties of the programmed hearing instrument 60. In an embodiment, the middleman 30 may have paid a first price for the hearing instrument 20. The invoice may in this embodiment comprise a reduction in the valuation by the first price.

In some embodiments, the hearing instrument 20 may include: a microphone configured for conversion of sound into an audio signal; a processing unit coupled to the microphone, wherein the processing unit is programmable to provide a hearing loss compensated output signal that compensates for a hearing loss of a user based at least in part on the audio signal; and a speaker coupled to the processing unit; wherein the processing unit includes a first functional property, the first functional property having a first locked state and a first unlocked state; wherein when the first functional property is in the first locked state, it is unavailable to the user, and when the first functional property is in the first unlocked state, it is available to the user.

In some embodiments, the processing unit is configured to be programmed by the programming station 40 to place the first functional property at the first locked state or the first unlocked state.

In some embodiments, the first functional property is resided in the processing unit of the hearing instrument 20 even when the first functional property is in the first unlocked state.

In some embodiments, the processing unit of the hearing instrument 20 comprises a firmware that includes the first functional property.

In some embodiments, the processing unit of the hearing instrument 20 includes a non-transitory medium for storing information indicating whether the first functional property is at the first locked state or the first unlocked state.

In some embodiments, the processing unit of the hearing instrument 20 is configured to receive a security ID from the programming station 40.

As used in this specification, the term "substantially" refers to a degree that is more than 50% (e.g., 75%, 80%, 90%, 95%, 100%, etc.) of the full degree. For example, the phrase "substantially all functional properties available to the manufacturer" may refer to all of the functional properties available to the manufacturer, or to any number of functional properties that is more than 50% of all of the ones available to the manufacturer.

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A method of providing a hearing instrument, comprising:

providing, at a manufacturer, the hearing instrument with a firmware which comprises a plurality of selectable functional properties;

providing the hearing instrument from the manufacturer to a middleman for programming the hearing instrument, wherein the firmware of the hearing instrument is programmable according to a selection of at least one of the plurality of selectable functional properties, and wherein after the firmware of the hearing instrument is programmed according to the selection of the at least one of the plurality of selectable functional properties, the hearing instrument becomes a programmed hearing instrument; and receiving, at the manufacturer, data regarding the selection of the at least one of the plurality of selectable functional properties;

wherein the hearing instrument is configured to receive a security identification provided by a programming station of the middleman, and to store the security identification; and wherein the plurality of selectable functional properties comprises a plurality of signal processing properties selectable for processing audio signal, noise signal, or both the audio signal and the noise signal.

2. The method according to claim 1, wherein the firmware of the hearing instrument comprises a majority of all functional properties available to the manufacturer.

3. The method according to claim 1, wherein at least one or all of the selectable functional properties can be locked or unlocked.

4. The method according to claim 3, wherein when one of the selectable functional properties is locked, it is unavailable to the end user in the programmed hearing instrument, and when the one of the selectable functional properties is unlocked, it is available to the end user in the programmed hearing instrument.

5. The method according to claim 1, wherein at least one or all of the selectable functional properties can be locked or unlocked at the middleman.

6. The method according to claim 1, wherein at least one or all of the selectable functional properties can be locked or unlocked by a process at the manufacturer.

7. The method according to claim 6, wherein at least one of the plurality of selectable functional properties is unlocked by the manufacturer.

8. The method according to claim 1, wherein the hearing instrument is provided to the middleman at a first price.

9. The method according to claim 8, further comprising billing the end user at a second price, wherein the second price is larger than the first price.

10. The method according to claim 8, further comprising billing the end user at a second price, wherein the second price reflects the selection.

11. The method according to claim 1, wherein at least one or all of the selectable functional properties are locked by the manufacturer before the act of providing the hearing instrument to the middleman.

12. The method according to claim 1, wherein at least one or all of the selectable functional properties are unlocked by the manufacturer before the act of providing the hearing instrument to the middleman.

13. The method according to claim 1, further comprising communicatively coupling the hearing instrument with a programming station at the middleman by establishing a wired or a wireless communication link between the programming station and the hearing instrument.

14. The method according to claim 13, wherein the wireless communication link is a short-range wireless communication link.

15. The method according to claim 14, wherein the short-range wireless communication link is a Bluetooth Low Energy communication link.

16. The method according to claim 1, wherein the act of receiving the data regarding the selection comprises establishing a communication link between a programming station at the middle man and a server located at the manufacturer.

17. The method according to claim 16, wherein the communication link comprises a public network.

18. The method according to claim 17, wherein the public network comprises the Internet.

19. The method according to claim 1, further comprising programming the firmware of the hearing instrument according to the selection; wherein the act of programming comprises:

generating the security identification at a programming station; and storing the security identification on a memory device contained in the hearing instrument.

20. The method according to claim 1, wherein the security identification comprises information about the selection.

21. The method according to claim 1, wherein the security identification is generated at a programming station utilizing a security key, and wherein the security key is provided to the middleman in a registration process using a server located at the manufacturer.

22. The method according to claim 1, further comprising billing the middleman based on the data regarding the selection.

23. A hearing instrument comprising programmable selectable functional properties, wherein the hearing instrument is programmed according to claim 1.

24. A hearing instrument comprising:

a microphone configured for conversion of sound into an audio signal;

a processing unit coupled to the microphone, wherein the processing unit is programmable to provide a hearing loss compensated output signal that compensates for a hearing loss of a user based at least in part on the audio signal; and a speaker coupled to the processing unit;

wherein the processing unit includes a first functional property, the first functional property having a first locked state and a first unlocked state;

wherein when the first functional property is in the first locked state, it is unavailable to the user, and when the first functional property is in the first unlocked state, it is available to the user;

wherein the hearing instrument is configured to receive a security identification from a programming station of a middleman, and to store the security identification; and wherein the first functional property comprises a signal processing property for processing the audio signal or a noise signal.

25. The hearing instrument of claim 24, wherein the processing unit is configured to be programmed by a programming station to place the first functional property at the first locked state or the first unlocked state.

26. The hearing instrument of claim 24, wherein the first functional property is resided in the processing unit even when the first functional property is in the first unlocked state.

27. The hearing instrument of claim 24, wherein the processing unit comprises a firmware that includes the first functional property.

28. The hearing instrument of claim 24, wherein the processing unit includes a non-transitory medium for storing information indicating whether the first functional property is at the first locked state or the first unlocked state.

29. The hearing instrument of claim 24, wherein the processing unit is configured to receive the security identification from a programming station.

30. The hearing instrument of claim 24, wherein the processing unit includes a non-transitory medium storing information regarding the first functional property.

31. The hearing instrument of claim 24, wherein the hearing instrument comprises a behind-the-ear (BTE) device, an in-the-ear (ITE) device, an in-the-canal (ITC) device, or a binaural hearing system.

* * * * *